United States Patent [19]

Tanigami et al.

[11] Patent Number: 4,642,279

[45] Date of Patent: Feb. 10, 1987

[54] PHOTOSENSITIVE MEMBER WITH AN INSULATING LAYER OF AMORPHOUS SILICON

[75] Inventors: Yukio Tanigami, Amagasaki; Shuji Iino, Itami; Mitsutoshi Nakamura, Osaka, all of Japan

[73] Assignee: Minolta Camera Kabushiki Kaisha, Osaka, Japan

[21] Appl. No.: 753,588

[22] Filed: Jul. 10, 1985

[30] Foreign Application Priority Data

Jul. 14, 1984 [JP] Japan ..... 59-146199

[51] Int. Cl.[4] ..... G03G 5/14

[52] U.S. Cl. ..... 430/66; 430/84; 430/95

[58] Field of Search ..... 430/57, 65, 84, 95, 430/66

[56] References Cited

U.S. PATENT DOCUMENTS 4,465,750 8/1984 Ogawa et al. ..... 430/84

4,483,911 11/1984 Ogawa et al. ..... 430/84

4,539,283 9/1985 Shirai et al. ..... 430/65

FOREIGN PATENT DOCUMENTS 2094550 9/1982 United Kingdom .

*Primary Examiner*—John L. Goodrow

*Attorney, Agent, or Firm*—Burns, Doane, Swecker & Mathis

[57] ABSTRACT

The present invention relates to a photosensitive member which includes a photoconductive layer of amorphous silicon and an insulating layer formed thereover and including amorphous silicon, carbon and an element in Group III A of the Periodic Table. Carbon is included in an amount of about 35 to 65 atomic % at the outer most surface of the insulating layer and a minimum amount at the interface with the photoconductive layer. The Group III A element is included to control a majority carrier of the insulating layer to be a polarity opposite to the polarity of charging.

9 Claims, 6 Drawing Figures

PHOTOSENSITIVE MEMBER WITH AN INSULATING LAYER OF AMORPHOUS SILICON

BACKGROUND OF THE INVENTION

1. Field of the Invention

The present invention relates to a photosensitive member which has a photoconductive layer containing amorphous silicon, and more particularly to a photosensitive member which has an insulation layer formed over the photoconductive layer.

2. Description of the Prior Art

For the past several years, attention has been focused on the application to photosensitive members of amorphous silicon (hereinafter referred to as "a-Si") which is produced by the glow discharge decomposition process or sputtering process. Similarly, attention has been directed to amorphous silicon-germanium (hereinafter referred to as "a-Si:Ge") having improved sensitivity in the region of long wavelengths for use in forming images by a semiconductor laser. Such promising application is attributable to the fact that for use in photosensitive members, a-Si and a-Si:Ge are exceedingly superior to the conventional selenium and CdS materials in resistance to environmetal pollution, heat and abrasion, photosensitive characteristics, etc.

However, a-Si or a-Si:Ge has the drawback of being low in dark resistivity and unusable as it is for a photoconductive layer which also serves as a charge retaining layer. It has therefore been proposed to incorporate oxygen or nitrogen into the material to improve the dark resistivity, but this conversely results in reduced photosensitivity, hence there is a limit to the content of the additive.

To overcome the drawback that the photosensitive member prepared from a-Si has a low dark resistivity and a very high rate of dark decay, it is also proposed to form an insulation layer of carbon-containing a-Si on a photoconductive a-Si layer to give improved charge retentivity (e.g. Published Unexamined Japanese Patent Application No. SHO 57-115551 and U.S. Pat. No. 4,465,750). The former publication discloses that carbon atoms are incorporated into a-Si at a high concentration of 40 to 90 atomic % (hereinafter abbreviated as "at. %"). Nevertheless, high carbon contents result in optical fatigue or reduced sensitivity, whereas improved chargeability requires a higher carbon concentration, which needs to be at least 70 at. % in some cases. Overcoat layers of such high carbon concentration are difficult to make by the common glow discharge decomposition process. The photosensitive member obtained, which has a high carbon concentration, exhibits poor adhesion to the photoconductive layer (of a-Si or a-Si:Ge), possibly creating blank streaks in the copy images obtained. Accordingly there is a limitation to the improvement of chargeability by increasing the carbon content.

SUMMARY OF THE INVENTION

The main object of the present invention is to provide a photosensitive member having a high dark resistivity and outstanding chargeability.

Another object of the invention is to provide a photosensitive member exhibiting excellent dark decay characteristics, having high charge retentivity and capable of giving satisfactory copy images.

Still another object of the invention is to provide a photosensitive member which comprises an a-Si photoconductive layer and an a-Si insulation layer formed over the layer and which is excellent in chargeability, low in residual potential, free of optical fatigue and outstanding in photosensitive characteristics, charge retentivity, surface hardness, moisture resistance and other properties.

These and other objects of the present invention can be fulfilled by a photosenstive member which comprises a photoconductive layer containing amorphous silicon and a light-transmitting insulation layer of amorphous silicon formed over the photoconductive layer and containing carbon, or carbon and oxygen, the photosensitive member being characterized in that the insulation layer is adjusted in polarity with an element in Group III A of the Periodic Table so that charges of a polarity opposite to the polarity of charging serve as the majority carrier. Further the carbon concentration of the light-transmitting insulation layer is low at the portion thereof adjoining the a-Si photoconductive layer, progressively increases toward the surface of the insulation layer with a gradient and is 35 to 65 atomic % at the outermost surface thereof. Further when required, the insulation layer may contain up to 10 atomic % of oxygen at the adjoining portion.

DETAILED DESCRIPTION OF THE INVENTION

Figure 1:
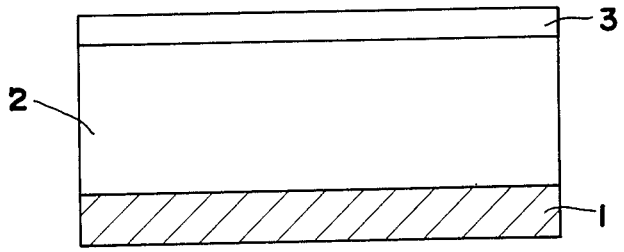
FIG. 1 is a diagram showing the construction of a photosensitive member embodying the invention.

FIG. 1 shows an embodiment of photosensitive member of the invention to illustrate the construction thereof. The photosensitive member comprises an electrically conductive substrate 1, a photoconductive layer 2 formed over the substrate 1 and at least containing a-Si, and an overcoat layer 3 of insulating and light-transmitting properties formed over the layer 2, containing a-Si and further containing carbon, or both carbon and oxygen.

The photoconductive layer 2 to be provided on the substrate 1 and containing a-Si is formed, for example, by the glow discharge decomposition process and has a thickness of 10 to 100 $\mu$m, preferably 10 to 60 $\mu$m. This process is practiced, for example, by supplying $SiH_4$, $Si_2H_6$ or like gas as entrained in $H_2$, Ar or like carrier gas into a reaction chamber in which a substrate is placed and which can be evacuated, and causing glow discharge with application of high-frequency power to form a hydrogen-containing a-Si photoconductive layer over the substrate. $GeH_4$ gas may be supplied conjointly to form an a-Si:Ge photoconductive layer. Since the photoconductive layer thus obtained has a lower dark resistivity than is desired, an impurity element (preferably boron) in Group III A of the Periodic Table and traces of oxygen, carbon, nitrogen, etc. may be incorporated into the layer.

The overcoat layer 3 containing a-Si and to be provided on the photoconductive layer 2 is formed similarly, for example, by the glow discharge decomposition process. The overcoat layer 3 is adapted to have a resistivity which is higher than that of the photoconductive layer 2 and which is progressively increased in the direction of thickness from the interface between the layers 2 and 3 toward the surface of the layer 3. Specifically stated, the overcoat layer 3 contains carbon, or both carbon and oxygen as incorporated in a-Si or a-Si:Ge and further has its polarity adjusted with an element in Group II A of the Periodic Table.

As already mentioned, it is known to afford improve photosensitive characteristics by introducing carbon into the a-Si of the overcoat layer and improving the insulating properties of the layer. However, if the carbon content is increased to such an extent as to obtain a remarkably improved chargeability by this technique, problems are encountered during use in that a pattern of blank spots occurs in copy images under the condition of high humidity and that repeated copying cycles impair the adhesion between the overcoat layer and the photoconductive layer to possibly cause separation of the overcoat. Additionally, the increased carbon content reduces the surface hardness, rendering the photosensitive member unsuited to a long period of repeated use.

According to the present invention, the polarity adjustment of the overcoat layer assures high chargeability and eliminates optical fatigue over a suitable range of carbon contents, preferably in the range of 35 to 65 at. % [{number of C atoms/(number of Si atoms+number of C atoms)}×100] at the outermost surface of the insulation layer.

The polarity adjustment of the overcoat layer according to the invention is conducted by controlling the valence electrons so that when the photosensitive member is negatively charged, charges of positive polarity serve as the majority carrier in the overcoat layer (p type), or that when the member is positively charged, charges of negative polarity serve as the majority carrier (n type).

When the overcoat layer thus adjusted in polarity is charged, the charges produced are retained in the overcoat layer and inhibited from injection into the photoconductive layer while in the dark, but the photo-carriers produced in the photoconductive layer upon exposure are allowed to move toward the surface easily. Consequently, the photosensitive member exhibits improved chargeability and reduced dark decay and is made less susceptible to optical fatigue.

The adjustment of polarity will be described in greater detail. It is now assumed that the photosensitive member shown in FIG. 1 is charged to a predetermined surface potential, for example, of negative polarity. At this time, the negative charges produced on the surface of the overcoat layer act to penetrate into the photoconductive layer 2 from the overcoat layer 3, leading to impaired dark decay and resulting in lowered charge retentivity. According to the present invention, therefore, the overcoat layer is doped with a Group IIIA element to control the valence electrons so as to render the overcoat layer itself serviceable as the p type. In this case, the positive charges serve as the majority carrier and become readily movable, whereas the negative charges become restrained from movement. With the negative charges thus inhibited from injection from the overcoat surface, remarkably improved dark decay is available. When the photosensitive member is exposed to light, holes and electrons are produced in the photoconductive layer. Of these, the electrons move toward the substrate, while the holes move through the overcoat layer to neutralize the negative charges on the overcoat layer. Since the positive charge is the majority carrier as stated above, the holes are readily movable toward the surface at this time, with the result that optical fatigue can be inhibited effectively.

To provide the p-type characteristics, the control of valence electrons is accomplished by doping the overcoat layer with a Group IIIA element, preferably boron, in an amount of 200 to 10000 ppm. Similarly, the n type is available by doping the layer with 5 to 20 ppm of boron. Strongly p-type or n-type characteristics are not desirable because optical fatigue could then result along with impaired chargeability.

Next, overcoat layers 3 will be described in which carbon is contained with a cencentration gradient with resepect to the direction of thickness of the layer. In this case, carbon is contained in two different modes. In one mode, the carbon content has such a gradient that it continuously increases from the interface between the overcoat layer 3 and the photoconductive layer 2 up to the outermost surface of the overcoat layer 3. In the other mode, the carbon content increases continuously with a gradient from the interface to a given thickness and then remains constant throughout a further portion of a thickness. In either case, the outermost surface portion of the overcoat layer preferably has a carbon content of 35 to 65 at. % [{number of C atoms/(number of C atoms+number of Si atoms)} ×100]. If the outermost surface portion is less than 35 at. % in carbon concentration, the photosensitive member has insufficient sensitivity, is prone to optical fatigue and fails to have the expected stability to moisture, whereas carbon contents above 65 at. % result in impaired surface hardness and produce defective copy images with blank streaks.

When the carbon content is continuously progressively increased from zero toward the outermost surface, the overcoat layer is about 0.02 to about 1.5 μm in thickness.

On the other hand, when the carbon content is continuously increased with a gradient from the interface between the layer 3 and the photoconductive layer 2 to a given thickness t1 and then made uniform up to the outermost surface throughout the remaining portion of a thickness t2, it is desired that the overcoat layer be about 0.03 to about 2.4 μm in thickness. In view of the photoconductive characteristics, the thickness t1 of the gradient portion is preferably about 200 to about 9000 angstroms because if the thickness t1 is too small, substantially the same fault as resulting from the absence of the gradient portion develops. Conversely, when the thickness is over 90,000 angstroms, a reduction of sensitivity and other problems are encountered. The thickness t2 of the layer portion having a uniform carbon content of 35 to 65 at. % is 0.01 to 1.5 μm, preferably 0.03 to 0.5 μm, because if the thickness is smaller, the layer 3 is unable to function satisfactorily as a protective layer in respect of resistance to moisture and friction, whereas larger thicknesses entail the drawback of lowered sensitivity and higher residual potential.

In this way, the carbon content is gradually decreased toward the photoconductive layer 2 to substantially eliminate a gap in carbon content between the overcoat layer 3 and the photoconductive layer 2. Stated more specifically, the carbon content of the overcoat layer is up to a maximum of 35 to 65 at. % in the outermost surface portion but is decreased with a gradient toward the photoconductive layer throughout the entire layer 3 or a portion thereof to become zero at the interface between the layers 2 and 3.

This improves the adhesion between the overcoat layer and the photoconductive layer against separation, further preventing the rise of residual potential due to an accumulation of charges at the interface and formation of indistinct images due to a lateral flow of accumulated charges.

The portion of the overcoat layer having a low carbon content, i.e. the portion adjacent to the photoconductive layer, absorbs light greatly and inhibits transmission of light toward the photoconductive layer, with the likelihood of causing a reduction of sensitivity and developing optical fatigue.

To overcome the above problem, the overcoat layer of the invention is doped with oxygen when required. When the layer is doped with oxygen, the low-carbon portion of the overcoat layer (i.e. the portion adjoining the photoconductive layer) is given improved light transmitting properties, becomes less prone to optical fatigue and exhibits enhanced adhesion to the photoconductive layer. Although the portion containing 35 to 65 at. % of carbon need not be intentionally doped with oxygen, increased surface hardness can be obtained if this portion is doped with a small amount (e.g. up to 3 to 4%) of oxygen.

According to the present invention, primarily the low-carbon gradient portion adjacent to the photoconductive layer is doped with oxygen. The amount of oxygen dope is 0.05 to 10 at. % [{number of 0 atoms/(number of Si atoms + number of C atoms + number of 0 toms)} × 100], preferably 0.1 to 5 at. %. The concentration of doping oxygen may be uniform in the direction of thickness of the layer 3, but can be increased with the decrease of the carbon content when required. When the oxygen content exceeds 5 at. %, especially 10 at. %, a residual potential will occur.

Figure 2:
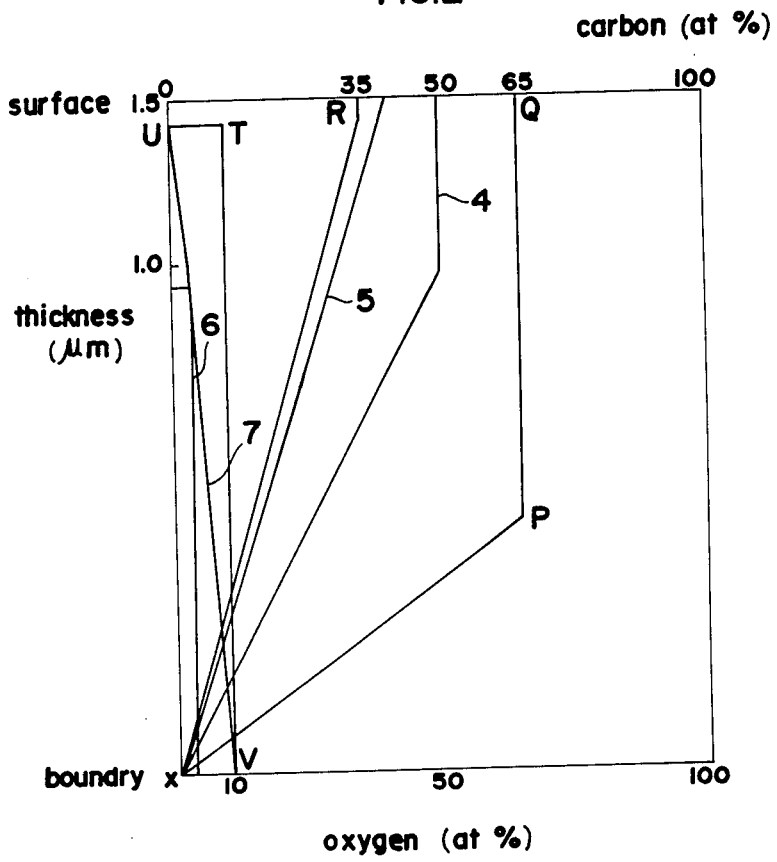
FIG. 2 is a diagram showing the carbon and oxygen concentrations in the light transmitting insulation layer of the photosensitive member of the present invention.

FIG. 2 schematically shows the mode of concentration of carbon, as well as oxygen, in the overcoat layer. Plotted as ordinate in the diagram is the thickness (1.5 μm as an example) of the overcoat layer 3 from the interface (0 μm between the layer 3 and the photoconductive layer 2 to the outermost surface of the layer 3. The carbon and oxygen concentrations are plotted as upper abscissa and lower abscissa, respectively. Region XPQRX schematically generally shows the range of carbon concentrations as related to the depth of the overcoat layer and defined by the invention. In this region, the carbon concentration is variable as represented by lines 4 and 5. Line 4 indicates that the carbon concentration is at a uniform level of 50 at. % from the surface of the overcoat layer to a depth of 0.6 μm, then gradually decreases and is substantially zero at the interface. Line 5 represents that the carbon concentration linearly decreases from the outermost surface portion toward the interface. In region XPQRX, line 4 or 5 is shiftable as desired.

Region XVTUX represents the range of doping oxygen concentrations. Line 6 indicates that the oxygen concentration is at a uniform level (0.3 at. %) in the region where the carbon content decreases as indicated by line 4. The oxygen concentration may be increased toward the interface as represented by line 7. Although the oxygen content is variable as desired within region XVTUX, it is especially desirable that oxygen be present in the carbon concentration gradient portion adjacent to the interface.

The Group IIIA element doping the overcoat layer may be present throughout the entire layer, while only the gradient portion indicated by line 4 in FIG. 2 or the region indicated by line 6 may be doped therewith. Both layers 2 and 3 contain 5 to 50 at. % of hydrogen.

EXAMPLE 1

Figure 3:
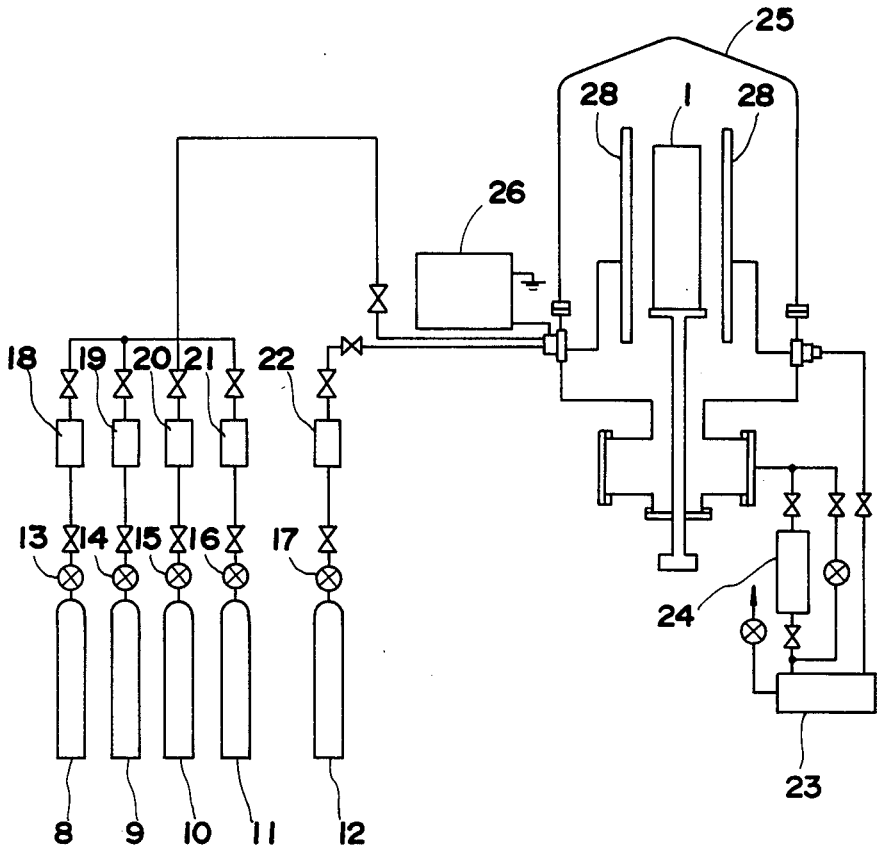
FIG. 3 is a diagram showing a glow discharge decomposition apparatus for producing the photosensitive member of the invention.

With reference to FIG. 3 showing a glow discharge decomposition apparatus, first a rotary pump 23 and then a diffusion pump 24 were operated to evacuate the interior of a reaction chamber 25 to a high vacuum of about $10^{-6}$ torr. Subsequently, first to third and fifth regulator valves 13, 14, 15, 17 were opened to introduce $H_2$ gas from a first tank 8, 100% $SiH_4$ gas from a second tank 9, $B_2H_6$ gas diluted to 200 ppm with $H_2$ from a third tank 10, and $O_2$ gas from a fifth tank 12, with each output pressure gauge adjusted to 1 kg/cm$^2$, into mass flow controllers 18, 19, 20, 22, respectively. With the mass flow controllers adjusted to a flow rate of 486.5 sccm for $H_2$, to 90 sccm for $SiH_4$, 22.5 sccm for $B_2H_6$ and to 1.0 sccm for $O_2$, the gases were introduced into the reaction chamber 25. After the gas flows stabilized, the internal pressure of the reaction chamber 25 was adjusted to 1.0 torr. On the other hand, an aluminum drum, 80 mm in diameter and serving as the electrically conductive substrate 1, was preheated to 240° C. When the gas flows and the internal pressure stabilized, a high-frequency power supply 26 was turned on to apply power of 250 watts (frequency: 13.56 MHz) across electrodes 28 to cause glow discharge. The glow discharge was continued for about 6 hours to form on the substrate 1 an a-Si photoconductive layer 2 having a thickness of about 20 μm and containing hydrogen, boron and a trace of oxygen.

Figure 4:
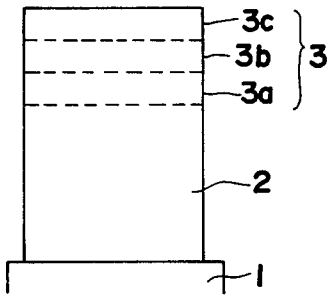
FIG. 4 is a diagram of the photosensitive member of FIG. 1 in further details.

After the a-Si photoconductive layer 2 was formed, a transition layer was formed without any interruption, i.e. without turning off the power supply 26. The $O_2$ gas supply was quickly adjusted to 3 sccm by the mass flow controller 22, and the $B_2H_6$ gas supply was adjusted by the mass flow controller 20 to give a $B_2H_6/SiH_4$ ratio of 100 ppm at the same time, and the gases were introduced into the reaction chamber 25 for about 2 minutes. During the two-minute period, $C_2H_4$ gas was supplied from a fourth tank 11 via a regulator valve 16, with the flow rate progressively varied from 0 to 45 sccm by a mass flow controller 21. Thus, an a-Si·C transition layer **3*a* (FIG. 4) was formed with a thickness of about 0.1 μm. Over a further period of about 3 minutes with continued application of the high-frequency power, the $SiH_4$ gas supply was uniformly reduced from 90 sccm to 30 sccm, and the $O_2$ gas supply from 3 sccm to 0 sccm, by adjusting the controller concerned. During this period, the $C_2H_4$ gas flow was maintained at 45 sccm. Consequently an a-Si·C transition layer 3*b* (FIG. 4**) was formed with a thickness of about 0.1 μm.

The apparatus was further maintained in the same state for 6 minutes, with the application of power but with the $B_2H_6$ gas supply discontinued,to form an overcoat outermost surface layer **3*c*** with a thickness of about 0.1 μm, whereupon the power supply was turned off.

The overcoat surface layer 3c thus formed contained about 40 at. % of carbon, and the transition layers 3a, 3b up to about 3 at. % of oxygen. The overcoat transition layers were found to have been adjusted to the n-type polarity with boron.

The photosensitive member thus obtained was set in a copying machine of the toner image transfer type (Model EP650Z, product of Minolta Camera Kabushiki Kaisha) and used for copying as charged positively. Sharp copy images were obtained with a high density, high resolution and good tone reproducibility. Even during 40,000 continual copying cycles, none of defects, such as blank streaks or spots, were found in the copy images, and the copies were all satisfactory. Although the photosensitive member was further used for copying under the high-temperature, high-humidity conditions of 30° C., 85% R.H., no difference was found between the results achieved and those at the usual temperature, humidity conditions in electrophotographic characteristics of the member and copy image characteristics.

EXAMPLES 2-6 AND COMPARATIVE EXAMPLES 1-3

A photosensitive member was prepared in the same manner as in Example 1 with the exception of increasing the ethylene supply from 0 to Z sccm at a constant rate for forming the transition layer 3a and maintaining the ethylene supply at the unchanged rate Z sccm for forming the transition layer 3b and the surface layer 3c.

The above procedure was repeated varying the Z value as listed in Table 1, which also shows the carbon content of the overcoat layer of each member obtained, as determined by the Auger analysis.

TABLE 1

| | Comp. Ex. | | Example | | | | | Comp. Ex. |
|---|---|---|---|---|---|---|---|---|
| | 1 | 2 | 2 | 3 | 4 | 5 | 6 | 3 |
| Photosensitive member number | A | B | C | D | E | F | G | H |
| $C_2H_4$ flow rate (Z, sccm) | 10 | 25 | 35 | 45 | 70 | 120 | 150 | 200 |
| Carbon content (at. %) | 10 | 25 | 35 | 40 | 50 | 60 | 65 | 70 |

The photosensitive members obtained were used for continually producing 40,000 copies with the same machine as used in Example 1. The member of Comparative Example 3 produced copy images with blank streaks. Further when tested under the conditions of 30° C., 85% R.H., the members of Comparative Examples 1 and 2 gave copies with disturbed images. These results indicate that when the overcoat layer has an insufficient carbon content, low moisture resistance results, and that an excess of carbon impairs the surface hardness and produces copy images with blank streaks. Accordingly, the proper carbon content is 35 to 65 at. %.

EXAMPLES 7-11 AND COMPARATIVE EXAMPLES 4 AND 5

A photosensitive member was prepared in the same manner as in Example 1 with the exception of quickly increasing the oxygen supply from 1 to Y sccm for forming the transition layer 3a, decreasing the oxygen supply from Y to 0 sccm at a constant rate for the transition layer 3b and adjusting the oxygen supply to 0 sccm for the surface layer 3c.

The above procedure was repeated varying the Y value as listed in Table 2, which also shows the maximum oxygen content of the transition layers of each member obtained, as determined by the Auger analysis.

TABLE 2

| | Comp. Ex. | Example | | | | | Comp. Ex. |
|---|---|---|---|---|---|---|---|
| | 4 | 7 | 8 | 9 | 10 | 11 | 5 |
| Photosensitive member number | I | J | K | L | M | N | |
| $O_2$ flow rate (Y, sccm) | 0 | 0.1 | 1 | 3 | 6 | 12 | 50 |
| Oxygen content (at. %) | 0 | 0.1 | 1 | 3 | 5 | 10 | 30 |

The photosensitive members obtained were set on a tester and subjected to repeated corona charging and erasing tests.

Consequently, a reduction was observed in the surface potential on the member of Comparative Example 4 containing no oxygen in the transition layers. The test results further indicated that an increase in the oxygen content tends to decrease the reduction of the surface potential. Since the reduction of surface potential indicates the degree of optical fatigue, the degree of optical fatigue was determined from the difference between the surface potential $V_{01}$ at the first rotation and the surface potential $V_{010}$ at the tenth rotation according to the following equation.

$$\text{Degree of optical fatigue} = \{(V_{01} - V_{010})/V_{01}\} \times 100$$

Figure 5:
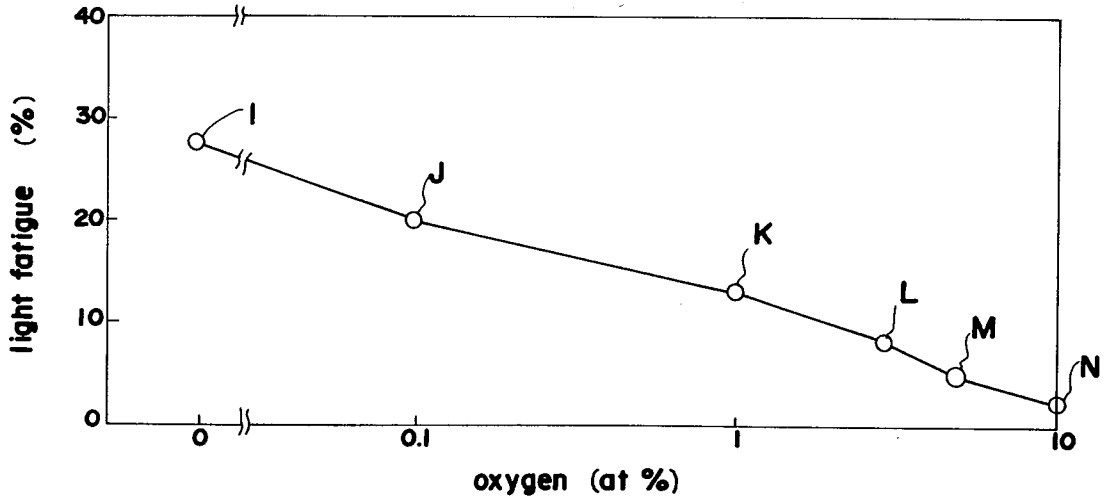
FIG. 5 is a graph showing the relationship between the light fatigue and oxygen concentration.

FIG. 5 shows the relation between the degree of optial fatigue and the oxygen content of the transition layers.

Figure 6:
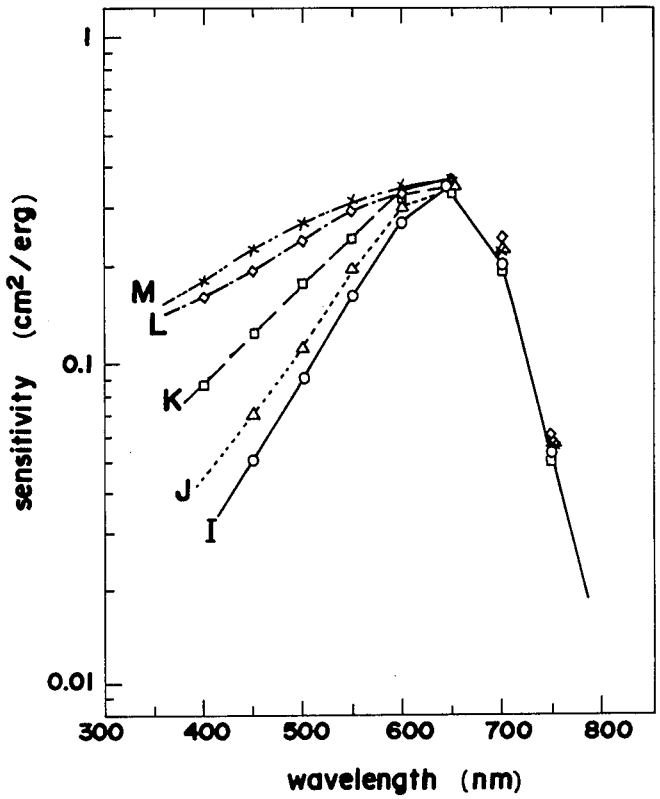
FIG. 6 is a graph showing the sensitivities of the photosensitive members according to the present invention.

FIG. 6 reveals that the increase in the oxygen content of the transition layers affords improved spectral sensitivity, especially at shorter wavelengths.

Nevertheless, the photosensitive member of Comparative Example 5 having a high oxygen content produced disturbed copy images even in an environment of usual temperature and usual humidity, failing to give sharp images by the common electrophotographic process. Although the photosensitive member of Example 11 was free of the above drawback, the member was found to produce foggy copy images after making several thousand copies when tested continuously using the same copying machine as in Example 1. This tendency became pronounced when it was used further repeatedly. These results indicate that the especially preferred oxygen content of the transition layers is in the range of 0.1 to 5 at. %.

COMPARATIVE EXAMPLES 6-11

An a-Si photoconductive layer 2 was formed under the same conditions as in Example 1. Subsequently, the high-frequency power supply was turned off, all the mass flow controllers were set to a flow rate of 0, and the reaction chamber 25 was fully degassed. The following gases were then introduced into the chamber by adjusting the controllers concerned: $H_2$ gas from the first tank 8 at 486.5 sccm, 100% $SiH_4$ gas from the second tank 9 at 30 sccm, $B_2H_6$ gas diluted to 200 ppm with $H_2$ gas from the third tank 10 at 1.5 sccm, and $C_2H_4$ gas from the fourth tank 11 at 45 sccm. After the gas flows stabilized, the power supply (250 watts) was turned on again to form a layer for 6 minutes, whereupon the power supply was turned off. The photosensitive member thus obtained corresponds to the one prepared in Example 1 in which the transition layers 3a and 3b are not included.

Several photosensitive members were prepared in the same manner as above except that only the $C_2H_4$ gas flow rate was changed as listed in Table 3, which also shows the results.

TABLE 3

| Comparative Example | 6 | 7 | 8 | 9 | 10 | 11 |
|---|---|---|---|---|---|---|
| $C_2H_4$ flow rate (sccm) | 10 | 25 | 35 | 45 | 70 | 120 |
| Carbon content (at. %) | 10 | 25 | 35 | 40 | 50 | 60 |

The photosensitive members were used each for continually producing 40,000 copies using the same copying machine as in Example 1. The members of Comparative Examples 8, 9, 10 and 11 all produced copy images with blank streaks. This was attributable to the separation of the overcoat layer occurring during the cleaning step of the copying operation owing to the poor adhesion of the layer to the photoconductive layer. When the members were thereafter tested under the high-temperature, high-humidity conditions of 30° C., 85% R.H., those of Comparative Examples 6 and 7 gave disturbed copy images. The above results show that the transition layers 3a and 3b are essential in preventing the separation and affording high moisture resistance at the same time.

EXAMPLES 12 AND 13 AND COMPARATIVE EXAMPLES 12 AND 13

Photosensitive members were prepared in the same manner as in Example 1 with the exception of changing the $B_2H_6/SiH_4$ ratio as shown in Table 4 for forming the transition layers 3a and 3b. The members were negatively charged and checked for chargeability and residual potential. Table 4 also shows the results.

TABLE 4

| | Comp. Ex. | Example | | Comp. Ex. |
|---|---|---|---|---|
| | 12 | 12 | 13 | 13 |
| $B_2H_6/SiH_4$ (ppm) | 0 | 200 | 2000 | 20000 |
| Chargeability | × | ○ | ◎ | × |
| Residual potential (Vr) | × | ○ | ○ | × |
| Chargeability: | ◎: $V_0 \geqq 600$ (V) | | | |
| | ○: 300 (V) $\leqq V_0 < 600$ (V) | | | |
| | ×: $V_0 < 300$ (V) | | | |
| Residual potential: | ○: Low | | | |
| | ×: High | | | |

EXAMPLE 14 AND COMPARATIVE EXAMPLE 14

Photosensitive members were prepared in the same manner as in Example 1 with the exception of changing the $B_2H_6/SiH_4$ ratio as shown in Table 5 for forming the transition layers 3a and 3b. The members were positively charged and checked for chargeability and residual potential, with the results also given in Table 5.

TABLE 5

| | Example | | Comp. Ex. |
|---|---|---|---|
| | 1 | 14 | 14 |
| $B_2H_6/SiH_4$ (ppm) | 10 | 20 | 100 |

TABLE 5-continued

| | Example | | Comp. Ex. |
|---|---|---|---|
| | 1 | 14 | 14 |
| Chargeability | ◎ | ○ | × |
| Residual potential (Vr) | ○ | ○ | × |

The symbols◎,○and × represent the same meaning as above.

What is claimed is:

1. A photosensitive member which comprises:

a conductive substrate;

a photoconductive layer including amorphous silicon and having a thickness of about 10 to 100 microns; and an insulating layer formed on said photoconductive layer and including amorphous silicon, carbon and an element in Group III A of the Periodic Table, said carbon being included in an amount of about 35 to 65 atomic % at the outermost surface of said insulation layer and the amount is minimum at the boundry with said photoconductive layer, and said Group III A element being included to control a majority carrier of said layer to be a polarity opposite to the polarity of charging.

2. A photosensitive member as claimed in claim 1 wherein said Group III A element is included in the amount of about 5 to 20 ppm for positive charging.

3. A photosensitive member as claimed in claim 1 wherein said Group III A element is included in the amount of 200 to 10,000 ppm for negative charging.

4. A photosensitive member as claimed in claim 1 wherein said carbon is included in said insulating layer in a gradient manner to continuously increase from the boundry with said photoconductive layer to the outermost surface of said insulating layer.

5. A photosensitive member as claimed in claim 1 wherein said carbon is included in said insulating layer in a gradient manner to continuously increase from the boundry with said photoconductive layer to a given thickness and at constant amount to the outermost surface of said insulating layer.

6. A photosensitive member as claimed in claim 4 wherein the thickness of said insulating layer is about 0.02 to 1.5 microns.

7. A photosensitive member as claimed in claim 5 wherein the thickness of said insulating layer is about 0.03 to 2.4 microns.

8. A photosensitive member as claimed in claim 1 wherein said insulating layer further include oxygen in, an amount of about 0.05 to 10 atomic %.

9. A photosensitive member which comprises:

a conductive substrate;

a photoconductive layer including amorphous silicon and having a thickness of about 10 to 100 microns; and an insulating layer formed on said photoconductive layer and including amorphous silicon, carbon, oxygen in an amount of about 0.05 to 10 atomic % and an element in Group III A of the periodic Table, said carbon being included in an amount of about 35 to 65 atomic % at the outermost surface of said insulation layer and a minimum at the boundary with said photoconductive layer, and said Group III A element being included to control a majority carrier of said layer to be a polarity opposite to the polarity of charging.

* * * * *